US005378110A

United States Patent [19]

Ress, Jr.

[11] Patent Number: 5,378,110

[45] Date of Patent: Jan. 3, 1995

[54] COMPOSITE COMPRESSOR ROTOR WITH REMOVABLE AIRFOILS

[75] Inventor: Robert A. Ress, Jr., Carmel, Ind.

[73] Assignee: United Technologies Corporation, Hartford, Conn.

[21] Appl. No.: 944,387

[22] Filed: Sep. 14, 1992

[51] Int. Cl.[6] ..... F03B 3/12

[52] U.S. Cl. ..... 416/244 R; 416/230; 416/299 R

[58] Field of Search ..... 416/198 A, 230, 229 A, 416/244 A

[56] References Cited

U.S. PATENT DOCUMENTS

| | | | |
|---|---|---|---|
| 3,679,324 | 7/1972 | Stargardter | 416/229 A |
| 4,111,606 | 9/1978 | Prewo | 416/230 |
| 4,339,229 | 7/1982 | Rossman | 416/230 |

FOREIGN PATENT DOCUMENTS

| | | | |
|---|---|---|---|
| 1056070 | 2/1952 | France | 416/198 A |
| 3101250 | 8/1982 | Germany | 416/198 A |

*Primary Examiner*—Edward K. Look
*Assistant Examiner*—Mark Sgantzos
*Attorney, Agent, or Firm*—Robert E. Greenstien

[57] ABSTRACT

In a gas compressor engine, a rotor to which turbine blades (airfoils) are mounted, is constructed of a fiber composite material. In a first zone of the rotor, a first group of fibers are oriented circumferentially, in the direction of rotor rotation. A second set of fibers are oriented off-axis along the entire longitudinal length of the rotor. The first group of fibers overlay the second group only in specific zones, creating zones in which only the off-axis fibers are located. Race-track shaped apertures are cut in these second zones between fibers and these apertures receive the compressor blades that are inserted from the interior of the rotor. The first zones also provide circumferential seals to receive the base of each compressor blade. The first zones are constructed by building up layers of the circumferential fibers in the first zones.

11 Claims, 3 Drawing Sheets

COMPOSITE COMPRESSOR ROTOR WITH REMOVABLE AIRFOILS

TECHNICAL FIELD

This invention relates to gas turbine engines and, in particular, techniques for installing compressor blades in a compressor rotor.

BACKGROUND OF THE INVENTION

U.S. Pat. No. 3,813,185 shows a structure for rotor blades in a turbo machine (e.g., a gas turbine engine) comprising a substantially cylindrical or a conical hollow drum of fibrous material and a plurality of metal blade carrier bars, attached side by side on each side of the blades. The art techniques revealed in that patent are representative of state-of-the-art applications of composite manufacturing techniques, as applied to gas turbine engine rotors. Other rotor techniques used in the prior art consist of entirely metallic or alloy rotors with machined slots that receive the rotor blades.

Some lightweight compressor rotor designs utilize an integrally-bladed Ti MMC drum. It is a common goal to use compressor airfoils that are integral with the rotor itself. When a Ti MMC drum is employed, the integral airfoils are made of a Ti alloy similar to that of the drum matrix material, which permits metallurgical joining of the two. While this arrangement allows for high rim speed capabilities, maximum discharge temperatures are limited to the 1400 to 1500 F. range due to the capability of available materials.

DISCLOSURE OF THE INVENTION

An object of the invention is to provide a lightweight compressor rotor design that incorporates replaceable airfoils and allows for operation at high rim speeds and elevated discharge temperatures.

According to the present invention, a gas turbine compressor rotor consists of a one piece fiber reinforced composite drum with replaceable airfoils. Airfoils are located in circumferential zones or bands in which fibers extend at an angle ("off-axis") to the drum's rotational axis. The airfoils are located between these fibers in apertures, preferably shaped like a racetrack, the fibers extending parallel with straight sides of the aperture. On each side of the zone or band containing the airfoils, these fibers overlay circumferentially applied fibers, creating additional zones or bands that sandwich the zones or bands containing the air/oils and that carry the airfoil loads. The off-axis fibers provide overall drum stiffness and establish a load path that strengthens the drum around apertures in the zones containing the airfoils.

According to the invention, the fibers in the circumferentially reinforced zones are built up in layers into a tapered seat along the interior of the rotor that receives the airfoil base.

According to one aspect of the invention, the airfoils are retained radially at static conditions by split snap rings that expand outwardly within the drum, holding the airfoils in place.

According to one aspect of the invention, airfoils are constructed either from a lightweight composite material, such as COMPGLAS brand composite material or a lightweight, non-burning titanium aluminide.

According to another aspect of the invention, the fiber reinforced rotor drum employs either a metal matrix composite (MMC) or a ceramic matrix composite (CMC) material system.

A feature of the present invention, the zoned fiber approach, produces bands of off-axis orientation that in-turn are bounded by circumferential fiber orientations at each compressor stage location, forming monolithic regions with which the airfoil apertures are machined. This deliberate absence of fibers in the aperture area assures that no cut fibers exist in the finished drum, which would reduce strength and provide sites for free edge stresses. These monolithic sites greatly simplify the machining of the apertures. Other features and benefits of the invention will be apparent to one skilled in the art from the following discussion.

BEST MODE FOR CARRYING OUT THE INVENTION

Figure 1:
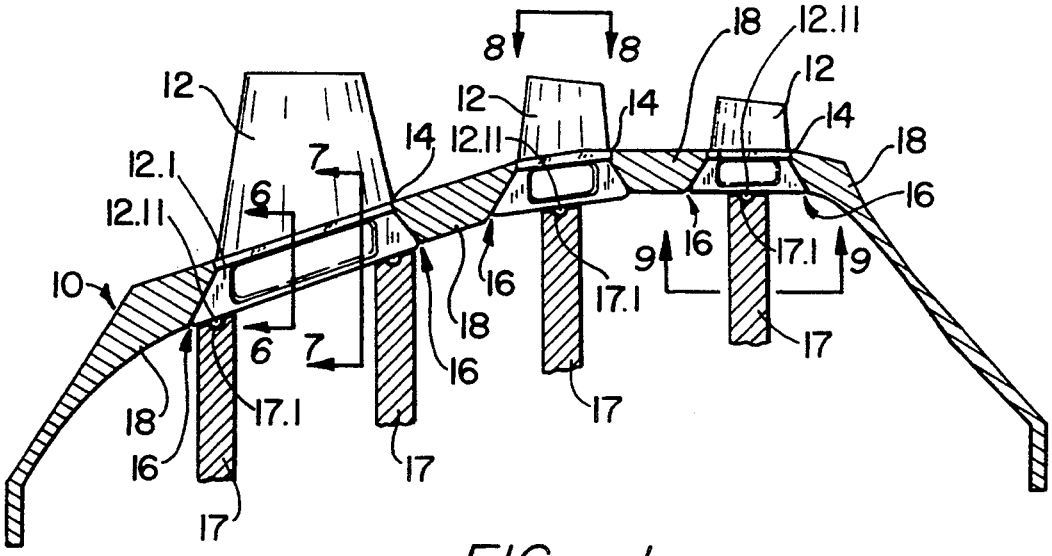
FIG. 1 is a cross-section of a three-stage rotor embodying the present invention.

In FIG. 1, a gas turbine rotor 10 basically a cylindrical drum, supports three stages of gas turbine rotor blades (airfoils) 12. The rotor is constructed from either a metal matrix composite (MMC) or a ceramic matrix composite (CMC) material system, as explained below. Each blade is located in an aperture 14 cut in circumferential zones or bands 16, and each blade may be made of known materials, but preferably COMPGLAS brand composite material or a lightweight, non-burning titanium aluminide. Bi-axially reinforced border zones 18 are located on both sides of the zone 16, the two zones 18 and the zone 16 defining first, second and third composite bands on the rotor. The cross-section shown in FIG. 1, illustrates that the border zones define tapered slots that receive congruous tapered base portions 12.1 of each blade. A ring 17, which is located inside the rotor, is notched at 17.1, to hold the airfoils in place when the rotor is stationary. The base portions 12.1 of the airfoils contain bosses 17.1 that rest in the notches.

Figure 6:
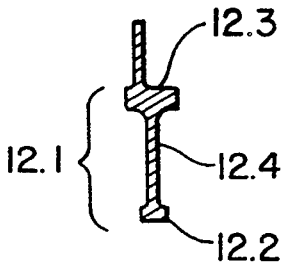
FIG. 6 is a section along 6—6 in FIG. 1.
Figure 8:
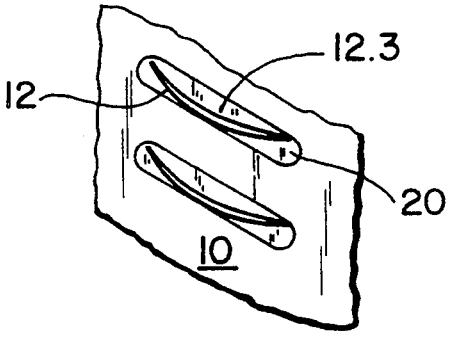
FIG. 8 is a plan view in the direction 8—8 in FIG. 1.
Figure 7:
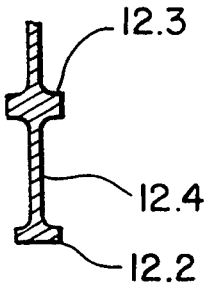
FIG. 7 is a section along 7—7 in FIG. 1.
Figure 9:
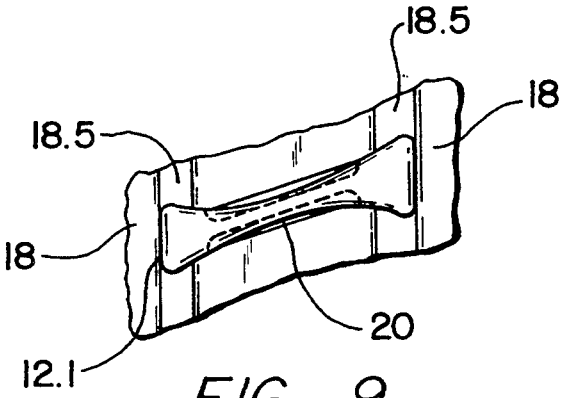
FIG. 9 is a plan view in the direction 9—9 in FIG. 1.

FIGS. 6 and 7 show that the base portion 12.1 of each blade have an "I-beam" shape, defining in effect a tapered I-beam base with a lower load bearing surface 12.2 joined to an upper load bearing surface 12.3 by a center section 12.4. As is best shown in the plan view of the base portion 12.1 in FIG. 3, these sections 12.2, 12.3 and 12.4 dimensioned relative to each other to provide the tapered profile that characterizes the base portion 12.1 to fit congruently between the zones 18. FIGS. 8 and 9 show the top and bottom portions or sections of the blade, also oval or race-tracked, like the aperture, to conform to a race-track aperture 20. The upper portion of each blade has a racetrack perimeter. This perimeter provides a seal between the blade to the interior portion of the rotor. The blade is structurally held in place due to the congruent fit of the base portion 12.1 between the zones 18.

Figure 2:
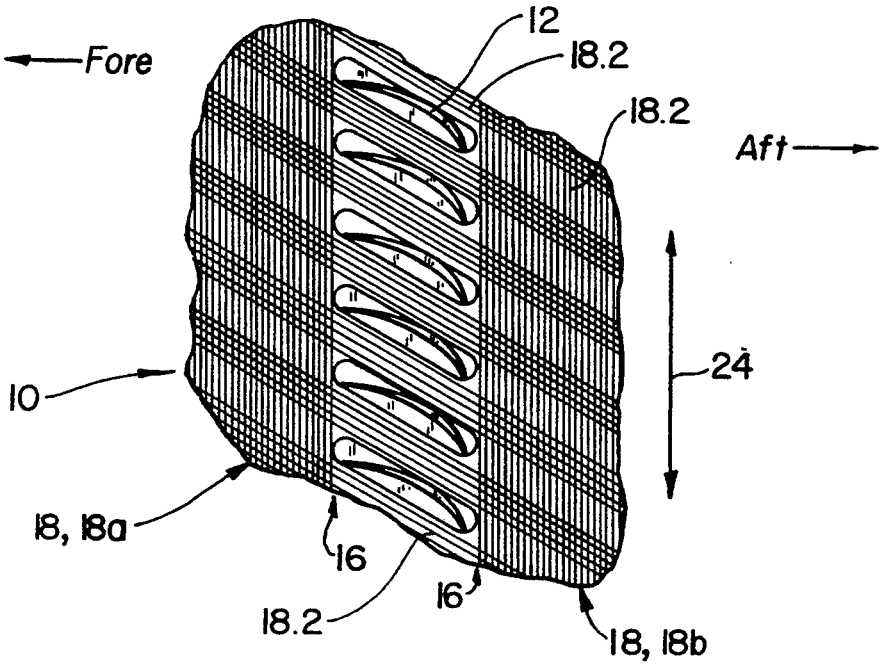
FIG. 2 is a simplified planned view of a portion of the rotor to show the orientation of the fibers according to the present invention.

Referring to FIG. 2, it shows in zones 18 that the fiber matrix consists of a first group of fibers 18.1 that extend circumferentially in the direction of rotor rotation 24. A group of fibers 18.2 is at an oblique angle to the first group of strands but also oblique to the axis of rotation. These extend continuously and in parallel with each other, forming a single rotor shell. These "off-axis" fibers 18.2 between two zones 18*a* and 18*b* and through the zone 16. Each aperture 20 is located within zone 16 but between the off-axis fibers 18.2. That is, when placing (machining) an aperture 20 in the zone 16, no off-axis strands are cut. The space between the strands in the zone is formed by the composite bonding material. Preferably, the fibers are made of silicon carbide and the binder comprises titanium or a ceramic material.

Figure 3:
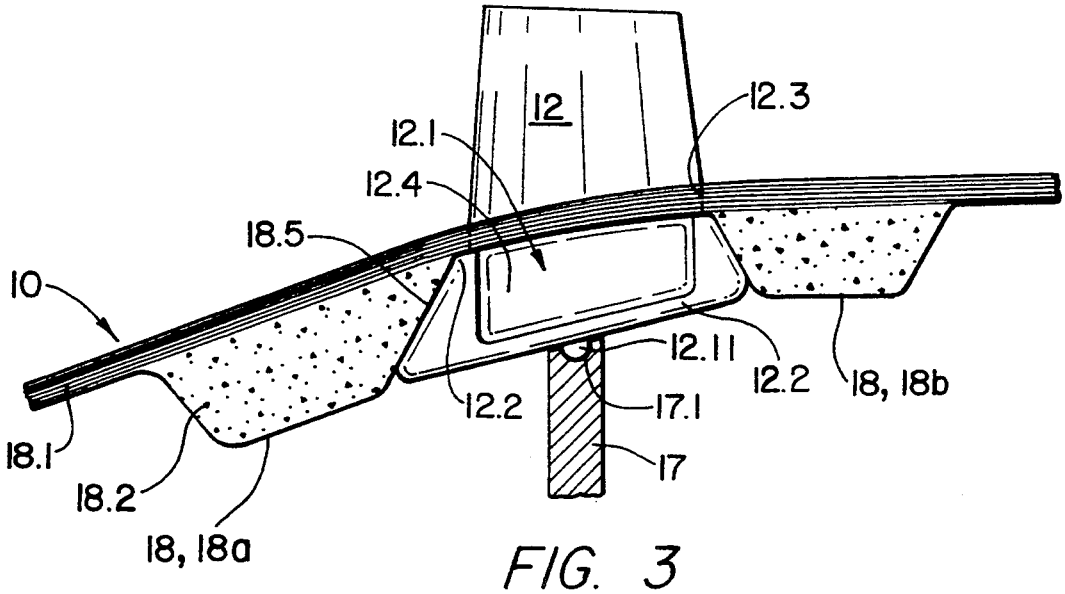
FIG. 3 is a section of a portion of the rotor.

With the aid of FIG. 3, it can be appreciated that the zones 18 are built up of many layers of circumferential fiber groups, forming the tapered support areas 18*a*, 18*b*, i.e., circular ribs or lands on the rotor extending radially inward from the shell, which consists of the off-axis fibers 18.2 as explained previously. Zone 16 is comparatively thin, consisting of only a few layers of the off-axis fibers 18.2. This zone or band 16 should be seen as consisting only of the strands 18.2 and being bordered by the two bands 18*a*, 18*b* in which the strands 18.1 and 18.2 cross, as best shown in FIG. 2. The collective effect, however, is that the three zones give the rotor an I-beam cross-section and the associated rigidity.

Figure 4:
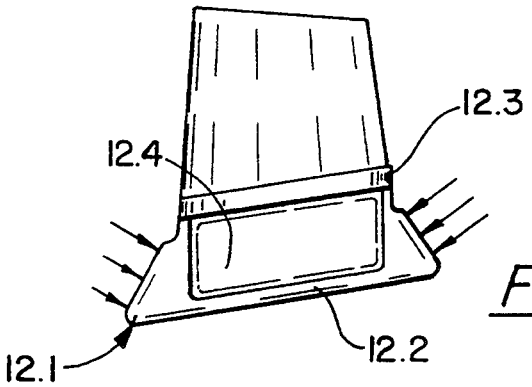
FIG. 4 is an elevation of a rotor blade according to the invention.
Figure 5:
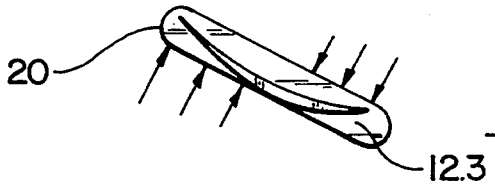
FIG. 5 is a planned view of a rotor blade according to the present invention.

FIG. 4 depicts airfoil centrifugal reaction forces on the base 12.1 of the blade forces transmitted to the zones 18 along bearing surface 18.5 in. FIG. 9 FIG. 5 similarly shows airfoil gas load reaction forces that are applied to the blade through the aperture 20. In actuality, those forces are applied to the portion of the I-beam sections of each blade.

With the benefit of the foregoing discussion, one skilled in the art may be able to make modifications in whole or in part to a described embodiment of the invention without departing from the true scope and spirit of the invention set forth in the following claims.

I claim:

1. A gas turbine engine rotor assembly characterized by:

a first plurality of continuous fibers in a binder, said fibers extending parallel with each other between ends of the rotor at an angle to a rotor rotational axis;

a second plurality of fibers in a binder, said fibers being located between longitudinal locations along said rotational axis on the rotor and extending circumferentially around a rotational axis of the rotor to define first and second bands in which the first and second plurality of fibers overlap and to define a third band, between said first and second bands, containing only said first plurality of fibers;

apertures located in said third band between two fibers in said first plurality of fibers; and an airfoil located in said aperture.

2. The invention described in claim 1, further characterized by said airfoil having a base with edges that rest on said first and second zones and a ring in the interior of the rotor retaining each blade in said aperture.

3. The invention described in claim 1 further characterized in that said apertures have substantially straight parallel sides running parallel with fibers in said first plurality of fibers.

4. The invention described in claim 3 further characterized in that said fibers are silicon carbide and said binder comprises titanium.

5. A method for constructing a gas turbine rotor characterized by the steps:

placing a plurality of parallel and unbroken fibers in a binder, each continuously extending between ends of the rotor at an angle to a rotor rotational axis;

placing a second plurality of fibers in a binder and extending said second plurality of fibers circumferentially around the rotor in a direction that is normal to said rotational axis, said second plurality of fibers being located at selected locations in a longitudinal direction parallel to said rotational axis to define first and second bands in which the first and second plurality of fibers overlap and a third band between said first and second bands containing only said first plurality of fibers; and creating apertures in said third band, said apertures located between the fibers in said plurality of fibers and to receive airfoils.

6. The method described in claim 5 further characterized by the step of building up layers of fibers in said first and second bands in a direction extending radially towards a rotor rotational axis to form airfoil supports within an interior of the rotor.

7. The method described in claim 6 further characterized by the step of inserting an airfoil into said aperture from an interior of the rotor and pressing base edges of said airfoil against said supports and installing a ring in the interior of the rotor to hold said airfoil in said aperture.

8. The method described in claim 7, further characterized by the step of shaping the apertures with parallel sides that extend parallel to fibers in said first plurality of fibers.

9. The method described in claim 8, further characterized in that said fibers are made of silicon carbide and said binder comprises titanium.

10. In combination, a plurality of airfoils in a rotor, characterized in that:

the rotor comprises first, second and third bands of composite material, said first and second bands being separated by said third band, said third band comprising a first plurality of fibers that extend a longitudinal length of the rotor continuously and at an angle to a rotational axis of the rotor, said first and second bands comprising a first layer comprising said first plurality of fibers and additional layers of a second plurality of fibers producing circular ribs that extend radially inward from said first layer within an interior of the rotor, said second plurality of fibers extending parallel to each other and continuously in a circumferential direction normal to said axis of rotation; and apertures in said third band;

said airfoils being located in said apertures and having leading and trailing edges of airfoil base portions that rest on said ribs.

11. The combination described in claim 10, further characterized by a ring located within the interior of the rotor and engages bases of said airfoils in said interior to resiliently hold said airfoils in said apertures.

* * * * *